US011136831B2

(12) United States Patent
Kim et al.

(10) Patent No.: US 11,136,831 B2
(45) Date of Patent: Oct. 5, 2021

(54) MINING BIT AND METHOD OF MANUFACTURING THE BIT

(71) Applicant: EHWA DIAMOND INDUSTRIAL CO., LTD., Osan-si (KR)

(72) Inventors: Ki Ho Kim, Seongnam-si (KR); Jun Yong Yun, Suwon-si (KR); Hee Dong Park, Yongin-si (KR)

(73) Assignee: EHWA DIAMOND INDUSTRIAL CO., LTD., Osan-si (KR)

( * ) Notice: Subject to any disclaimer, the term of this patent is extended or adjusted under 35 U.S.C. 154(b) by 77 days.

(21) Appl. No.: 16/161,555

(22) Filed: Oct. 16, 2018

(65) Prior Publication Data

US 2019/0284878 A1 Sep. 19, 2019

(30) Foreign Application Priority Data

Mar. 18, 2018 (KR) ..... 10-2018-0031197

(51) Int. Cl.
*E21B 10/48* (2006.01)
*B22F 5/00* (2006.01)
*B22F 7/08* (2006.01)

(52) U.S. Cl.
CPC ..... *E21B 10/485* (2013.01); *B22F 5/00* (2013.01); *B22F 7/08* (2013.01); *B22F 2005/001* (2013.01)

(58) Field of Classification Search
CPC ..... E21B 10/48; E21B 10/485; B22F 5/00; B22F 7/08; B22F 2005/001; B22F 2007/066
See application file for complete search history.

(56) References Cited

U.S. PATENT DOCUMENTS 6,033,295 A * 3/2000 Fisher ..... B24D 3/06 451/540
2007/0051354 A1* 3/2007 Sung ..... C22C 21/06 125/12
2016/0201398 A1* 7/2016 Pearce ..... B24D 3/06 175/57

FOREIGN PATENT DOCUMENTS

KR 20010006016 1/2001
KR 20160048629 5/2016

* cited by examiner

*Primary Examiner* — George S Gray
(74) *Attorney, Agent, or Firm* — Cantor Colburn LLP

(57) ABSTRACT

A mining bit includes: a shank; and cutting tips attached to the shank, each cutting tip having a plurality of layers and a plurality of abrasive particles, wherein the layers have a shape of an arch with flat surfaces in such a manner as to be laminated onto each other in a horizontal direction with respect to a cut surface of each cutting tip, and a distance (D2) between the abrasive particles on the adjacent layers is less than a distance (D1) between the abrasive particles on each layer.

3 Claims, 7 Drawing Sheets

MINING BIT AND METHOD OF MANUFACTURING THE BIT

BACKGROUND OF THE INVENTION

Field of the Invention

The present invention relates to a mining bit and a method for manufacturing the same, and more particularly, to a mining bit and a method for manufacturing the same wherein cutting tips are provided to have abrasive particles arranged thereon in such a manner as to have a minimum distance between layers, thereby allowing the cutting tips to be always operated with uniform concentration.

Background of the Related Art

A mining bit is a part mounted on a mining drill, and the mining drill is equipment for directly drilling rock and collecting a rock sample to estimate distribution of mineral resources and an amount of mineral resource deposits. In the situation where a state of a material to be cut is not recognized, the mining drill generally bores the ground up to a depth of hundreds of meters to thousands of meters. In this case, there is a probability that the mining drill will collide against high hardness rock while it is working. During the drilling work, if cutting tips of the mining bit are broken and thus useless, the drilling work stops, and next, the broken cutting tip or the mining bit should be exchanged with new one, thereby undesirably causing high economical loss.

So as to ensure the continuity of the drilling work by the mining drill and to provide an appropriate work speed, on the other hand, the cutting tips for the mining drill, which are capable of satisfying the continuity of the drilling work and the appropriate work speed, should be required. Minimal requirement needed for the cutting tips are as follows: first, the cutting tips have to be easily made, secondly, abrasive particles have a high concentration, and thirdly, cut surfaces are rounded to induce optimal abrasion. At this time, each cutting tip has a shape of an arch having the same width and rounded on inner and outer surfaces thereof. So as to enhance the concentration of the abrasive particles, in detail, the abrasive particles are arranged under a pattern structure with given rules, and they have a small interlayer distance. If the cut surfaces of each cutting tip are rounded, further, the material to be cut can be gently cut during the drilling work.

Generally, the matrix portions of the mining bit are made through infiltration carried out by infiltrating a metal binder made with a single metal such as copper (Cu), tin (Sn), nickel (Ni), manganese (Mn) or the like or with their alloy into pores of a formed body made by mixing metal powder like tungsten (W), molybdenum (Mo), cobalt (Co) and so on with diamond particles, by heating the metal binder over a melting point, and by filling the metal binder in the interior of the formed body through a capillary force. Since the metal powder and the diamond particles are mixed with each other, by the way, the diamond particles are not distributed uniformly, thereby failing to obtain uniform abrasion. So as to solve the above-mentioned problems, a method for uniformly distributing the diamond particles with a given pattern has been developed in an industrial field of diamond tools, which is applied to a cutter, a grinder, and so on.

FIG. 1 is a perspective view showing a conventional cutting tip 100 with a given pattern arrangement. The conventional cutting tip 100 takes a shape of an arch having the same width and rounded on an inner surface 101 and an outer surface 102. At this time, the conventional cutting tip

100 is obtained by pre-laminating a plurality of layers 103 extended to a vertical direction v with respect to a cut surface A onto each other by a desired thickness and by finally pressurizing the laminated layers to obtain a final thickness W. Under the above-mentioned manufacturing method, it is possible to allow abrasive particles to be continuously exposed on the cut surface of the cutting tip according to the abrasion of the cutting tip. By the way, it is hard to make the arch-shaped cutting tip 100 through pressurization, forming, and sintering used in the conventional practice. So as to make the cutting tip 100 to a shape of an arch, in detail, the plurality of layers 103 is pressurized, bendingly formed, and sintered. In this case, by the way, the inner surface 101 and the outer surface 102 have different curvatures, so that it is almost impossible to make the arch-shaped cutting tip 100 through the conventional bending formability and sintering.

Referring to FIG. 1 as disclosed in Korean Patent Application Laid-open No. 2001-0006016, a cutting tip having a plurality of layers 103 extended to a vertical direction v with respect to a cut surface A in such a manner as to be laminated onto each other is made through infiltration. According to the conventional cutting tip, an inner surface 101 and an outer surface 102 are not rounded, and the cut surface A is rounded, so that the cutting tip does not have any shape of an arch, which is not adequate for the cutting tip for drilling. So as to laminate the plurality of layers 103 extended to the vertical direction v onto each other to the shape of the arch, however, the above-mentioned forming problems have to be solved.

On the other hand, a concentration of abrasive particles on the cutting tip 100 has to be uniform and maximized. If the concentration of the abrasive particles is not uniform, the layer 103 on which the abrasive particles P do not exist or are insufficient is exposed to the outside, so that the drilling work is not continuously carried out and uniform cutting is not obtained. If the concentration of the abrasive particles is low, further, it is impossible to appropriately handle a situation where a state of a material to be cut is not recognized. If the concentration of the abrasive particles is maximized, accordingly, the cutting tip is not damaged even though it collides against a relatively high hardness material to be cut during the drilling work, thereby performing the drilling work, without any trouble. However, the conventional cutting tips fail to satisfy the concentration of abrasive particles needed therefor.

SUMMARY OF THE INVENTION

Accordingly, the present invention has been made in view of the above-mentioned problems occurring in the prior art, and it is an object of the present invention to provide a mining bit and a method for manufacturing the same wherein a plurality of cutting tips are provided in such a manner as to be easily made with a high concentration of abrasive particles, rounded on a cut surface to induce optimal abrasion, and have a shape of an arch having the same width and rounded on inner and outer surfaces thereof.

To accomplish the above-mentioned object, according to an aspect of the present invention, there is provided a mining bit including: a shank rotatingly connected to a driving device; and cutting tips attached to the shank, each cutting tip having a plurality of layers and a plurality of abrasive particles arranged on the layers, wherein the layers have a shape of an arch with flat surfaces in such a manner as to be laminated onto each other in a horizontal direction with respect to a cut surface of each cutting tip, and a distance (D2) between the abrasive particles on the adjacent layers is less than a distance (D1) between the abrasive particles on each layer.

According to the present invention, desirably, an interlayer distance (S) is equal to or less than sizes (F) of the abrasive particles and is less than the radical root of ⅔ of the distance (D1) between the abrasive particles on each layer.

According to the present invention, desirably, the distance (D1) between the abrasive particles on each layer is determined in accordance with a distance between through holes of a drilling jig and is greater by 1.5 to 2.5 times than average sizes (F) of the abrasive particles.

According to the present invention, desirably, even though the abrasive particles are abraded and thus exposed to the outside, the abrasive particles are in a range of a given concentration (N) allowing the abrasive particles to be continuously distributed.

According to the present invention, desirably, the concentration (N) is greater than 40 con (concentration) and less than 80 con.

According to the present invention, desirably, spaces among the abrasive particles are filled with a metal binder through a capillary phenomenon.

According to the present invention, desirably, the cutting tips have backing layers having a height difference in a range of the interlayer distance (S).

To accomplish the above-mentioned object, according to another aspect of the present invention, there is provided a method for manufacturing a mining bit, including the steps of: so as to arrange abrasive particles satisfying a condition wherein a distance (D2) between the abrasive particles on adjacent layers is less than a distance (D1) between the abrasive particles on each layer, inserting the abrasive particles into a drilling jig having through holes larger than sizes F of the abrasive particles P after having a thin layer of metal powder applied thereto, taking a shape of an arch, being flattened, and defining the distance (D1) thereby; horizontally laminating the plurality of layers on which the abrasive particles are arranged by means of the drilling jig to make laminated formed bodies; seating the formed bodies onto cutting tip insertion grooves of a shank; disposing a metal binder along the shank to form cutting tips through infiltration performed by heating the metal binder; and unitarily infiltrating the cutting tips and the shank to finish manufacturing the mining bit.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENTS

Figure 1:
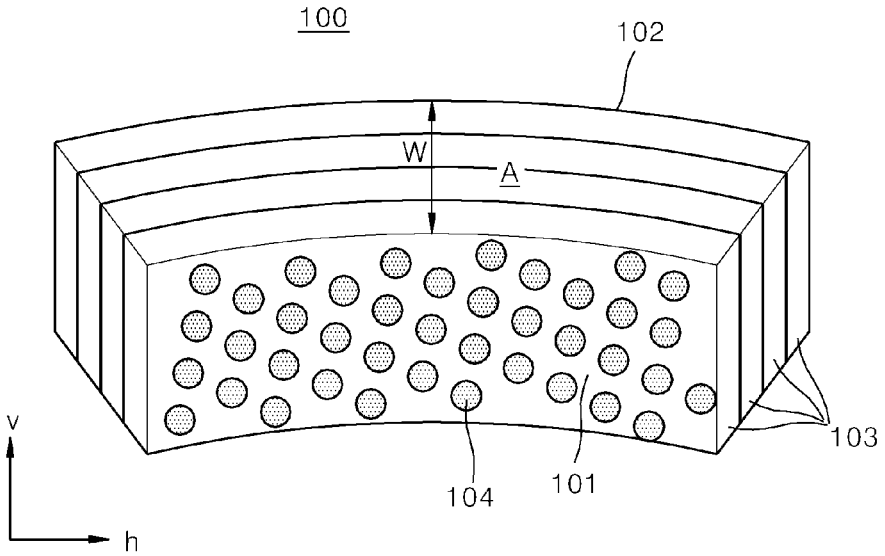
Fig. 1 Prior Art
FIG. 1 is a perspective view showing a conventional cutting tip with a pattern arrangement.

Now, an explanation on a mining bit and a method for manufacturing the same according to the present invention will be given with reference to the attached drawings. Before the present invention is disclosed and described, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. In the description, the thicknesses of the layers (patterns) and areas of the components shown in the drawing may be magnified for the clarity and convenience of the description. In the description, further, when it is said that one layer (pattern) is located "on", "above", "under", or "underside" another layer (pattern), it means that one layer (pattern) may be formed on another layer (pattern) as well as yet another layer (pattern) may exist between the two layers layer (patterns).

The present invention relates to a mining bit and a method for manufacturing the same wherein a plurality of cutting tips is made, through infiltration, by laminating a plurality of layers arranged horizontally with respect to a cut surface thereof under the condition where an interlayer distance is equal to or less than the sizes of abrasive particles defined as upper limit sizes according to ISO 6106 standard, so that each cutting tip is easily made, has a high concentration of abrasive particles, allows the cut surface to b rounded to induce optimal abrasion, and has a shape of an arch having the same width and rounded on the inner and outer surfaces thereof. Accordingly, structures and characteristics of the cutting tips made by laminating the plurality of layers arranged horizontally with respect to the cut surfaces thereof under the condition where the interlayer distance is equal to or less than the sizes of abrasive particles will be in detail described, and an explanation on effects of the maximum concentration of the abrasive particles will be in detail given. On the other hand, a mining drill is equipment for directly drilling rock and collecting a rock sample to estimate distribution of mineral resources and an amount of mineral resource deposits. The mining drill includes a mining bit having a shank and cutting tips.

Figure 2:
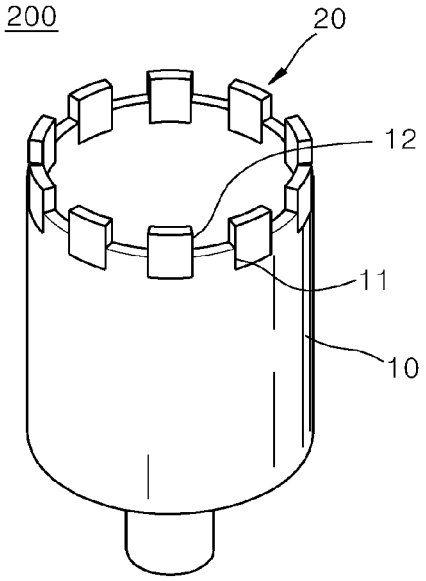
FIG. 2 is a perspective view showing a mining bit according to the present invention.

FIG. 2 is a perspective view showing a mining bit according to the present invention. It is to be understood that the disclosed embodiment is merely exemplary of the invention, which may be embodied in various forms.

As shown in FIG. 2, a mining bit 200 according to the present invention includes a cylindrical shank 10 rotatingly connected to a driving device of a mining drill and cutting tips 20 attached to the shank 10. The cutting tips 20 are spaced apart from each other by a given distance defined by a path 12 formed on an outer periphery of the shank 10. The paths 12 between the adjacent cutting tips 20 are formed to pass chips or cooling water therethrough. The sizes of the cutting tips 20 are appropriately designed according to their boring purposes. The cutting tips 20 are coupled to the cylindrical shank 10 in such a manner as to be equally spaced apart from each other, and accordingly, each tip 20 has a shape of an arch. In detail, each cutting tip 20 is curved correspondingly to a curvature of the shank 10 in such a manner as to be enlarged toward the outside of the shank 10.

Each cutting tip 20 is seated onto a cutting tip insertion groove 11 and is thus coupled to the shank 10, and the cutting tip insertion groove 11 serves to fix each cutting tip 20 to the shank 10. In the state where the cutting tips 20 are accommodatedly inserted into the cutting tip insertion grooves 11, the cutting tips 20 and the shank 10 are infiltrated together, thereby completing manufacturing the mining bit 200 according to the present invention. So as to allow the cutting tips 20 to be firmly fixed to the shank 10, at this time, the cutting tip insertion grooves 11 are desirably formed lower than the paths 12 of the shank 10.

The cutting tips 20 are made by means of infiltration. The infiltration is carried out by infiltrating a metal binder made with a single metal such as copper (Cu), tin (Sn), nickel (Ni), manganese (Mn) or the like or with their alloy into pores of a formed body made by mixing metal powder like tungsten (W), molybdenum (Mo), cobalt (Co) and so on with abrasive particles through the capillary force obtained by heating the metal binder over a melting point. The metal binder is an optimized material for the mining bit 200, and since it does not have any solubility with the metal powder constituting the formed body, it is not sintered, so that desirably, the cutting tips 20 are made by means of the infiltration.

Unlike the typical sintering, the infiltration does not have any process of sintering through pressurization, and in the process of infiltration, accordingly, the sizes of the cutting tips 20 are not varied to allow the cutting tips 20 and the shank 10 to be unitarily manufactured with accurate sizes. If shrinkage does not occur, distances between the abrasive particles are not decreased, and accordingly, a concentration at the step of the initial formed body can be kept. Unlike a general sintering process, in detail, the infiltration does not have any shrinkage, and therefore, the size of the formed body becomes a size of a final product. In the sintering process, an interlayer distance becomes decreased, but in the infiltration, an interlayer distance is constantly maintained. Accordingly, it is necessary to minimize the interlayer distance at the initial formed body manufacturing step so as to enhance the concentration of the abrasive particles.

Figure 3:
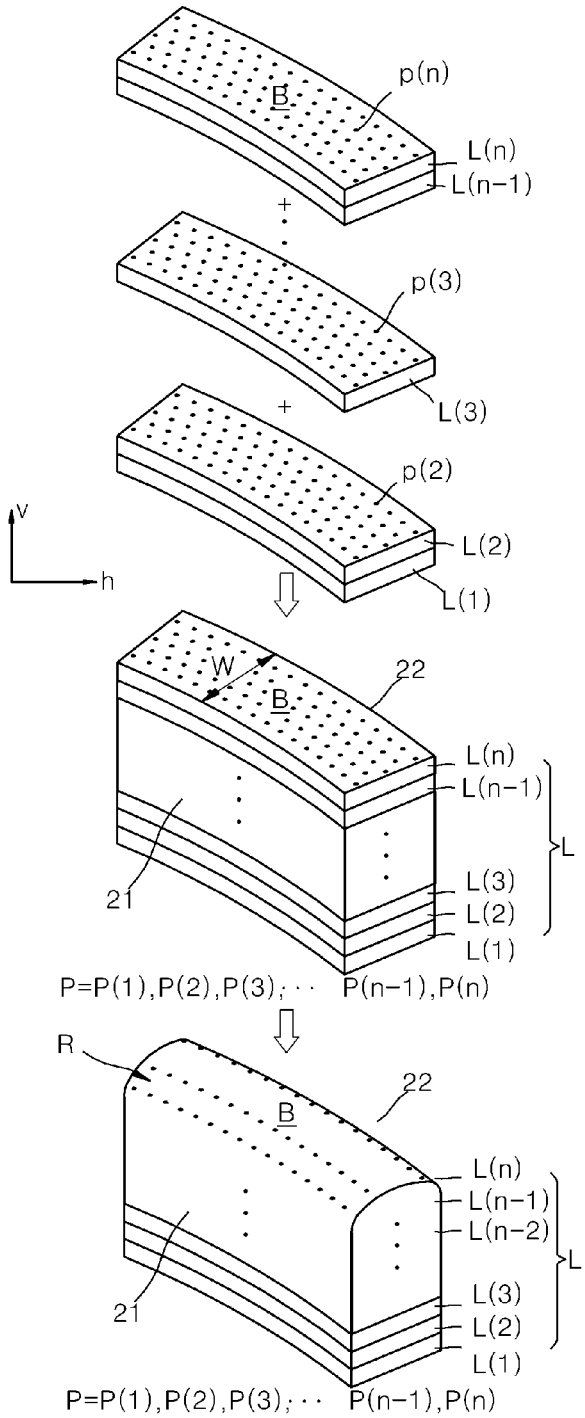
FIG. 3 is an exploded perspective view showing a manufacturing process of a cutting tip of the mining bit according to the present invention.

FIG. 3 is an exploded perspective view showing a manufacturing process of a cutting tip of the mining bit according to the present invention.

As shown in FIG. 3, each cutting tip 20 is formed by laminating n (wherein n is a natural number larger than 2) layers L (L(1), L(2), L(3), . . . , L(n−1) and L(n)) onto each other. As shown, the respective layers are curved to the shapes of arches in correspondence with to the curvature of the shank 10 and are also enlarged toward outer surfaces 22 thereof from inner surfaces 21 thereof. That is, each cutting tip 20 has the same width W, is rounded on the inner surface 21 and the outer surface 22. The length of the outer surface 22 is greater than that of the inner surface 21. The sizes of the cutting tips 20 and the number of layers L may be varied according to the structure, size and working environment of the mining drill to which the mining bit 200 of the present invention is applied.

A plurality of abrasive particles P (P(1), P(2), P(3), . . . , P(n−1) and P(n)) is arranged correspondingly on the layers L(1), L(2), L(3), . . . , L(n−1) and L(n) in such a manner as to satisfy the technical spirit of the present invention. An explanation on the arrangement of the abrasive particles will be in detail given later. The abrasive particles P include artificial diamond particles, natural diamond particles, cubic boron nitride CBN, and superabrasive particles, and among them, the artificial diamond particles are used most widely.

So as to arrange the abrasive particles P on the respective layers L, first, through holes larger than sizes F of the abrasive particles P are formed on a drilling jig for performing the arrangement of the abrasive particles P, and the abrasive particles P are insertedly fed into the through holes. At this time, the drilling jig may have a shape of an arch having the same width. If the abrasive particles P are inserted into the through holes of the drilling jig, accordingly, the layers L having the abrasive particles P arranged thereon become arched. Further, the drilling jig has a flat surface.

Each cutting tip 20 has a cutting surface B on which cutting occurs, and boring is performed on the cutting surface B. The layers L are extended horizontally h with respect to the cutting surface B. In detail, a cutting direction is vertical v with respect to the cutting surface B, and the layers L are located in a horizontal direction as a perpendicular direction to the vertical direction v on which cutting occurs. On the other hand, it is impossible to manufacture the cutting tip 20 wherein the layers L are arranged vertically v with respect to the cutting surface B in the conventional practice. That is, the conventional layers are bent, so that they have to be subjected to bending formability, but since the lengths between their inner and outer surfaces are different, it is impossible to perform the bending formability. In case of the bending formability for a thick formed body like the mining bit 200 according to the present invention, further, there is a limitation in precisely adjusting the curvatures and sizes of the respective layers due to spring back, which has been in detail explained before.

Contrarily, the cutting tip 20 is made by laminating the arch-shaped flat layers L onto each other in the horizontal direction h, and accordingly, the layers L are just laminated onto each other, without having any bending formability. If the bending formability is not carried out, it is not necessary to precisely adjust the curvatures and sizes of the respective layers L. So as to make the conventional cutting tip having the layers laminated in the vertical direction v, in detail, the bending formability (inclusive of sintering) has to be carried out, but according to the present invention, the layers L are just laminated onto each other, without any bending formability. Accordingly, the arch-shaped cutting tip 20 according to the present invention can be easily made.

On the other hand, both sides of the cutting surface B with respect to the circumferential direction of the shank 10 are desirably rounded R. If the cutting surface B is rounded R, impacts occurring during drilling are reducedly applied to the cutting surface B, and natural cutting occurs. The rounding is in advance designed, or it may be carried out during drilling. The rounding necessarily occurs during the drilling, but desirably, the rounding is in advance designed and surely induced. According to the present invention, the rounding designed in advance is suggested as an example.

Rounding R on the cutting surface B means that the edges of the inner surface 21 and the outer surface 22 on the cutting surface B are more abraded initially than a center of the cutting surface B. If the rounding R occurs, the abrasive particles P existing on the plurality of layers L are continuously exposed to the outside. This will be explained with reference to the concentration N as will be discussed later. According to the present invention, the abrasive particles P(1), P(2), and P(3) on the layers L(n), L(n−1), and L(n−2) are exposed to the outside, but actually, the abrasive particles P existing on a large number of layers L inclusive of the layers L(n), L(n−1), and L(n−2) may be exposed to the outside. The rounded portion may be varied according to the thicknesses and designs of the respective layers L. In spite of the rounding R, on the other hand, the abrasive particles P should be uniformly exposed to the outside, and in this case, the interlayer distance and concentration of the abrasive particles P are important. Hereinafter, an explanation on them will be in detail given.

Figure 4:
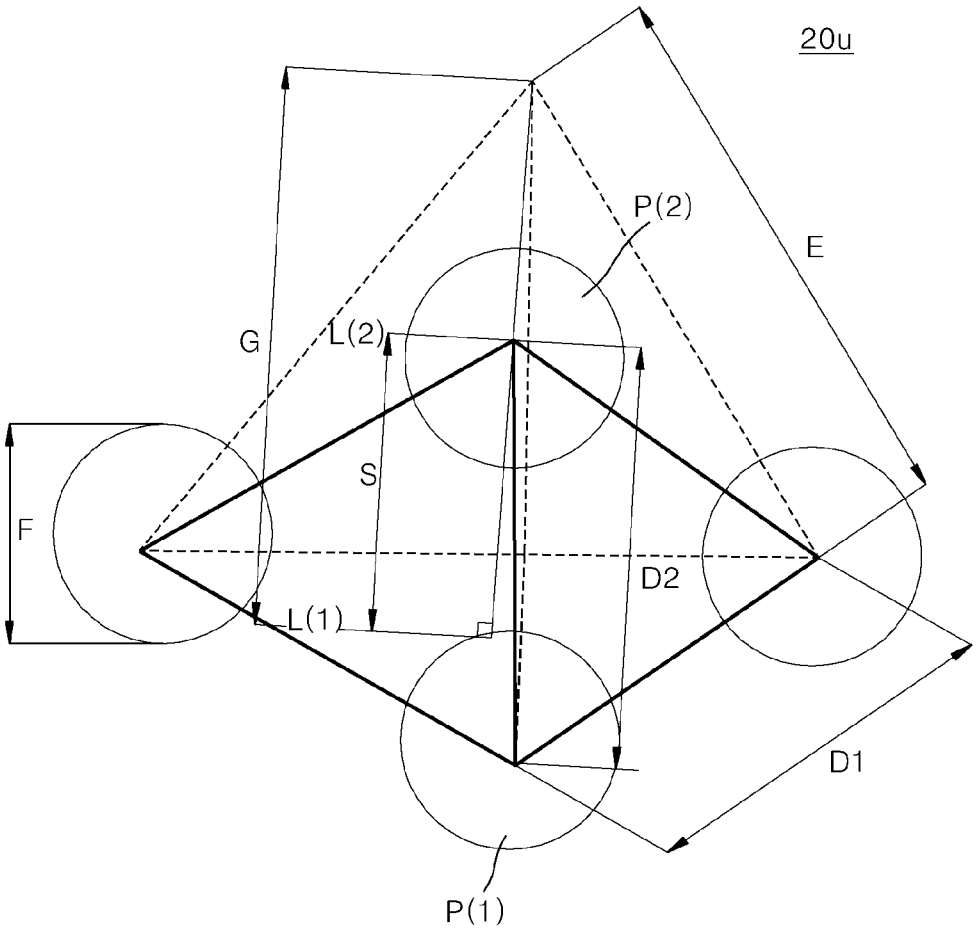
FIG. 4 is a concept view showing the arrangement of abrasive particles of the cutting tip of the mining bit according to the present invention.
Figure 5:
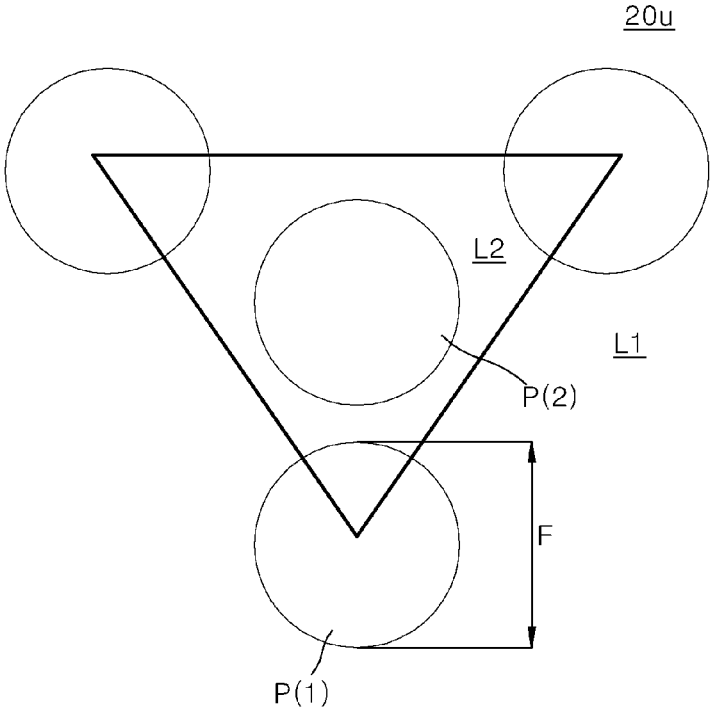
FIG. 5 is a plan view of FIG. 4.
Figure 6:
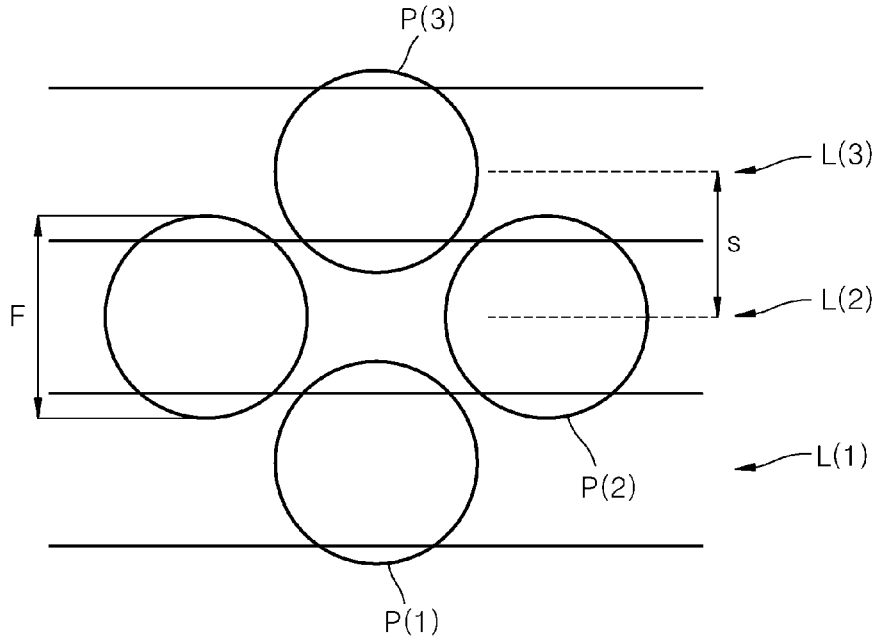
FIG. 6 is a view showing a relationship between an interlayer distance and the abrasive particles according to the present invention.

FIG. 4 is a concept view showing the arrangement of abrasive particles of the cutting tip of the mining bit according to the present invention, FIG. 5 is a plan view of FIG. 4, and FIG. 6 is a view showing a relationship between an interlayer distance and the abrasive particles according to the present invention. In this case, a minimal unit 20*u* of the nearest abrasive particles P is extracted. For the convenience of the description, further, given portions of the layers L(1), L(2), and L(3) as shown in FIG. 3 are selected, and the abrasive particles P(1), P(2), and P(3) existing on the layers L(1), L(2), and L(3) are displayed. The layers L and the abrasive particles P may be of course applied even to other layers and abrasive particles constituting the corresponding cutting tip 20.

Referring to FIGS. 4 to 6, the minimal unit 20*u* of the cutting tip 20 has a structure wherein an interlayer distance S of the abrasive particles P(1) and P(2) is three-dimensionally minimized. In this case, the minimal interlayer distance S will be first discussed, and a concentration of the abrasive particles P will be in detail explained later with reference to FIG. 7. According to the present invention, the abrasive particles P(1) and P(2) are close to the interlayer distance S and are at the same time three-dimensionally filled densely to achieve uniform concentration. At this time, the three dimension considers each layer L and the layer adjacent to the layer L. In detail, the layers L(1) and L(2) satisfy the three-dimensional condition.

In the minimal unit 20*u*, a center of the abrasive particle P(1) of the layer L(1) is located at a vertex of a tetrahedron, and a center of the abrasive particle P(2) of the layer L(2) is located at an interior of the tetrahedron. In this case, the tetrahedron is adopted for the convenience of the description and is indicated by an imaginary line. A length of one side of the tetrahedron is E. The distance between the layer L(1) on which the abrasive particle P(1) is located and the layer L(2) on which the abrasive particle P(2) is located is called the interlayer distance S according to the present invention. In detail, the interlayer distance S according to the present invention is a normal distance between the layer L(1) and the layer L(2). The center of the abrasive particle P(2) is desirably located on a normal G, and when considering tolerance occurring in the manufacturing process, it may be located near the normal G. The interlayer distance S is less than a length of the normal G as a height of the tetrahedron. The abrasive particle P(1) and the abrasive particle P(2) have the same sizes F as each other.

The length E of one side of the tetrahedron is equal to a distance D1 between centers of the abrasive particles P(1) on the layer L(1). On the other hand, a relationship G/E, that is, G/D1, between the length E of one side of the tetrahedron and the length of the normal G is theoretically about 0.816 as a radical root of ⅔. A relationship S/D1 between the distance D1 between centers of the abrasive particles P(1) on the layer L(1) and the interlayer distance S is less than the radical root of ⅔. According to the present invention, further, the interlayer distance S is equal to or less than the sizes F of the abrasive particle P(1) and the abrasive particle P(2).

Even though the interlayer distance S is less than the sizes F of the abrasive particle P(1) and the abrasive particle P(2), the abrasive particle P(2) of the layer L(2) is located toward the normal G from a center of a regular triangle formed of the three abrasive particles P(1), so that the abrasive particle P(1) and the abrasive particle P(2) do not collide against each other. Accordingly, the interlayer distance S satisfies that the S/D1 is less than the radical root of ⅔, and the interlayer distance S is equal to or less than the particle sizes F. Theoretically, the smallest interlayer distance S is ½ of the particle sizes F. If less than, the abrasive particle P(2) of the layer L(2) collides against the abrasive particle P(3) of the layer L(3), thereby failing to maintain the layers.

For example, it is assumed that the size F of the abrasive particle P(1) is 400 μm, and when considering the pitch between the through holes of the drilling jig as mentioned above, the distance D1 between centers of the abrasive particles P(1) on the layer L(1) is greater than 400 μm. That is, the distance D1 is 500 μm. Under the above-mentioned condition, the interlayer distance S is greater than 400 μm and less than about 408(500*0.816) μm. If the distance between the through holes of the drilling jig is 600 μm, the interlayer distance S is greater than 400 μm and less than about 490(600*0.816) μm. Accordingly, the distance D1 between centers of the abrasive particles P(1) on the layer L(1) is determined in accordance with the distance between the through holes of the drilling jig. Accordingly, the interlayer distance S satisfies that the S/D1 is less than the radical root of ⅔ and greater than F/2. At this time, the state where the interlayer distance S is F/2 is called the smallest interlayer distance S.

Under the conditions of the interlayer distance S, according to the present invention, a distance D2 between centers of the abrasive particles P located on the adjacent layers L is less than the distance D1 between the centers of the abrasive particles P(1) on the layer L. The relationship is mathematized by (D2/D1)<1. It is obvious that the distance D2 between centers of the abrasive particles P(1) and P(2) located on the adjacent layers L is less than the distance D1 between the centers of the abrasive particles P(1) on the layer L.

On the other hand, the sizes F of the abrasive particles P are defined as the upper limit sizes according to ISO 6106 standard. In case of 25/30 mesh, the upper limit size is 710 μm, and in case of 30/40 mesh, it is 590 μm. Further, in case of 40/50 mesh, it is 420 μm. The respective distances D1 among the adjacent abrasive particles P(1) on the layer L are not the same as one another and are desirably greater by 1.5 to 2.5 times than the average sizes F of the abrasive particles P. In consideration of the different particle sizes from each other, in this case, the average sizes are obtained to clearly distinguish the distance D1 therefrom. According to the present invention, the respective distances D1 are determined under the conditions wherein the S/D1 is less than the radical root of ⅔ and greater than F/2 and (D2/D1)<1. The mesh is selected according to the use purposes of the mining bit according to the present invention.

Figure 7:
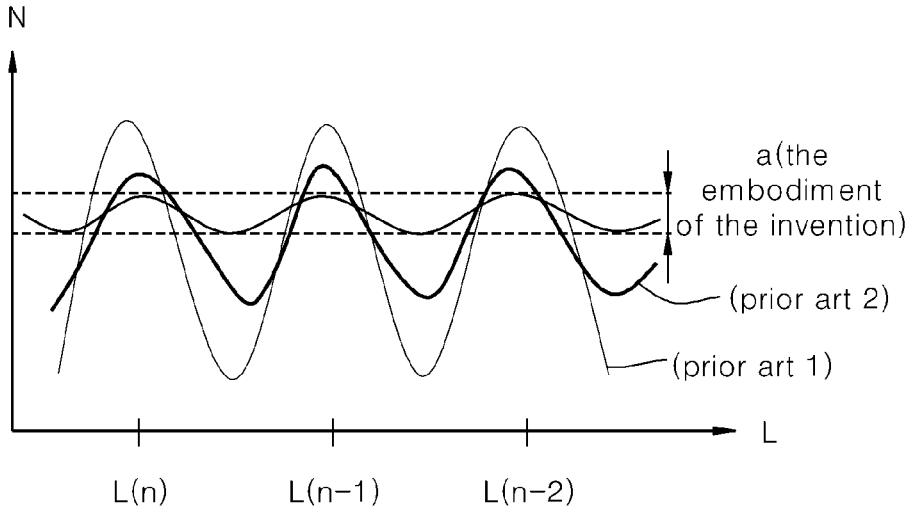
FIG. 7 is a graph showing the comparison of the present invention and the conventional practices in the concentration (N) of the abrasive particles with respect to the interlayer distance of the cutting tip.

FIG. 7 is a graph showing the comparison of the present invention and the conventional practices in the concentration (N) of the abrasive particles with respect to the interlayer distance of the cutting tip. According to the prior art 1, at this time, the interlayer distance S is relatively great, and according to the prior art 2, the interlayer distance S is not close to the interlayer distance S according to the present invention.

As shown in FIG. 7, if the layers L are exposed to the outside through the rounding, the abrasive particles P are exposed to the outside. The abrasive particles P are three-dimensionally exposed to the outside, together with the layers L. In the conventional practices, the arrangements of the abrasive particles P on the respective layers L do not satisfy the conditions of the interlayer distance S according to the present invention, and accordingly, discontinuity occurs so that the concentrations of the exposed abrasive particles P are repeatedly high and low. For example, high concentrations N occur on the centers of the layers L(n), L(n−1), and L(n−2), but low concentrations N occur on the edges of the adjacent layers L(n), L(n−1), and L(n−2). When viewed on the entire cutting tip, the concentration N of the exposed abrasive particles P has a shape of a waveform. Further, low concentrations N occur even when the abrasive particles P are rarely arranged. Particularly, in case of the prior art 1 where the interlayer distance S is relatively great, the discontinuity of the concentration occurs more seriously.

According to the present invention, contrarily, the abrasive particles P arranged on the layers L(n), L(n−1), and L(n−2) are three-dimensionally distributed with uniform concentrations N, so that they are arranged with a small concentration range a, while satisfying the condition of the interlayer distance S according to the present invention.

The width of the concentration range a is determined upon the condition of the interlayer distance S satisfying that the S/D1 is less than the radical root of ⅔ and greater than F/2. If the S/D1 is close to 50% of the sizes F of the abrasive particles P, the width of the concentration range a becomes small, and if it is close to the radical root of ⅔, the width of the concentration range a becomes large. Also, the abrasive particles P in the concentration range a are more continuously arranged than the prior arts. As the interlayer distance S between the adjacent layers L becomes small, the abrasive particles P always exist on arbitrary positions of the layers L through the continuous arrangements of the abrasive particles P.

According to the prior arts 1 and 2, contrarily, the abrasive particles P exist, without any satisfaction of the condition of the interlayer distance S according to the present invention, or do not exist. Like this, the case wherein the abrasive particles P satisfying the condition of the interlayer distance S according to the present invention always exist on the respective layers L and the adjacent layers L means the continuity of the abrasive particles P. Of course, according to the present invention, if the condition, (D2/D1)<1 is satisfied, the technical spirit of the present invention can be sufficiently realized.

The concentration N of the abrasive particles P according to the present invention is desirably greater than 40 con (concentration) and less than 80 con, more desirably, greater than 50 con. In case where the drill with 200 to 400 horsepower is used, at this time, if the concentration N is low, the cutting tip is suddenly abraded or the abrasive particles are easily separated from the cutting tip. Therefore, it is not desirable that the concentration N be less than 40 con. However, if the concentration N of the abrasive particles P is greater than 80 con, a load applied to one of the abrasive particles P is small, so that cutting is not performed well, and further, since the distances between the abrasive particles P are too small, it is hard to design the abrasive particles P of more than 80 con through a pattern arrangement.

Even if the edges of the cutting tip 20 having the concentration N satisfying the condition of the interlayer distance S are rounded or even if phase differences are a little generated, the abrasive particles P having the uniform concentration N are exposed to the outside. If the interlayer distance S is large, a portion where the abrasive particles P do not exist or are insufficient occurs when drilling is performed by the mining bit. If the abrasive particles P do not exist or are insufficient, the drilling is not performed well. In the drilling work, that is, continuous and uniform cutting is not performed. In case of the mining bit 200 according to the present invention, however, the abrasive particles P satisfying the condition of the interlayer distance S are three-dimensionally arranged, and they are thus exposed uniformly to the outside, thereby performing continuous and uniform cutting. Further, the abrasive particles P always come into contact with a material to be cut, and even though the material has high hardness, it does not give any damage to the cutting tip 20 according to the present invention.

Figure 8:
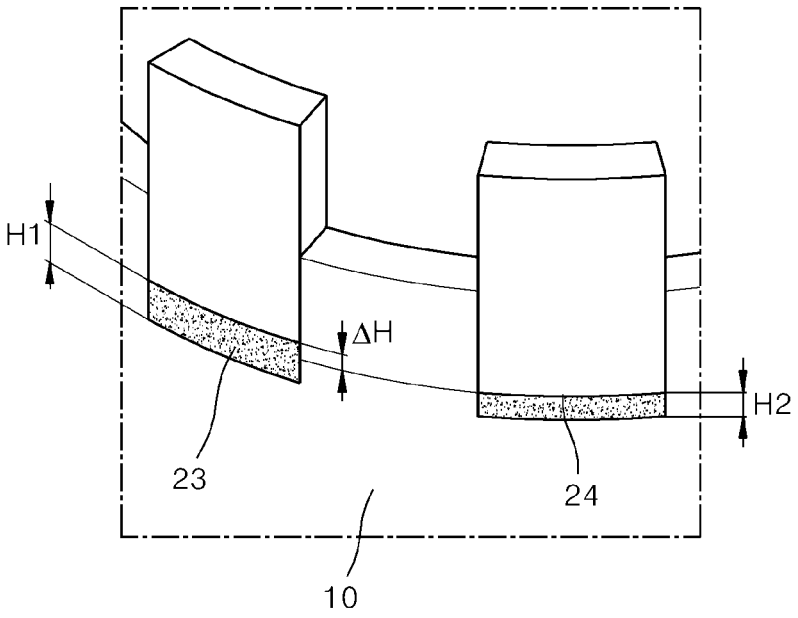
FIG. 8 is a partially perspective view showing another example of the mining bit according to the present invention.

FIG. 8 is a partially perspective view showing another example of the mining bit 200 according to the present invention. At this time, the example of the mining bit as shown in FIG. 8 is the same as the mining bit according to the present invention, except that backing layers 23 and 24 are additionally formed on the cutting tips 20. Accordingly, an explanation on the repeated portion with the mining bit 200 according to the present invention as shown in FIGS. 1 to 7 will be avoided for the brevity of the description.

As shown in FIG. 8, the adjacent cutting tips 20 have a first backing layer 23 having a first height H1 and a second backing layer 24 having a second height H2. The first and second backing layers 23 and 24 are formed in the cutting tip insertion grooves 11 and thus come into contact with the shank 10. The first height H1 is greater than the second height H2, thereby causing a height difference ΔH. The height difference ΔH is less than the interlayer distance S according to the present invention. Desirably, the height difference ΔH is 50% of the interlayer distance S according to the present invention. If there is the height difference ΔH, phase differences occur between the abrasive particles P during the adjacent cutting tips 20 rotate. The phase differences allow the concentration range a to be more reduced. In detail, the abrasive particles P of the cutting tips 20 are more continuously exposed than those having no phase differences. The height difference ΔH is gradually changeable every the cutting tip. At this time, the backing layers 23 and 24 have the same components as the metal binder and are desirably made in the forming step.

Figure 9:
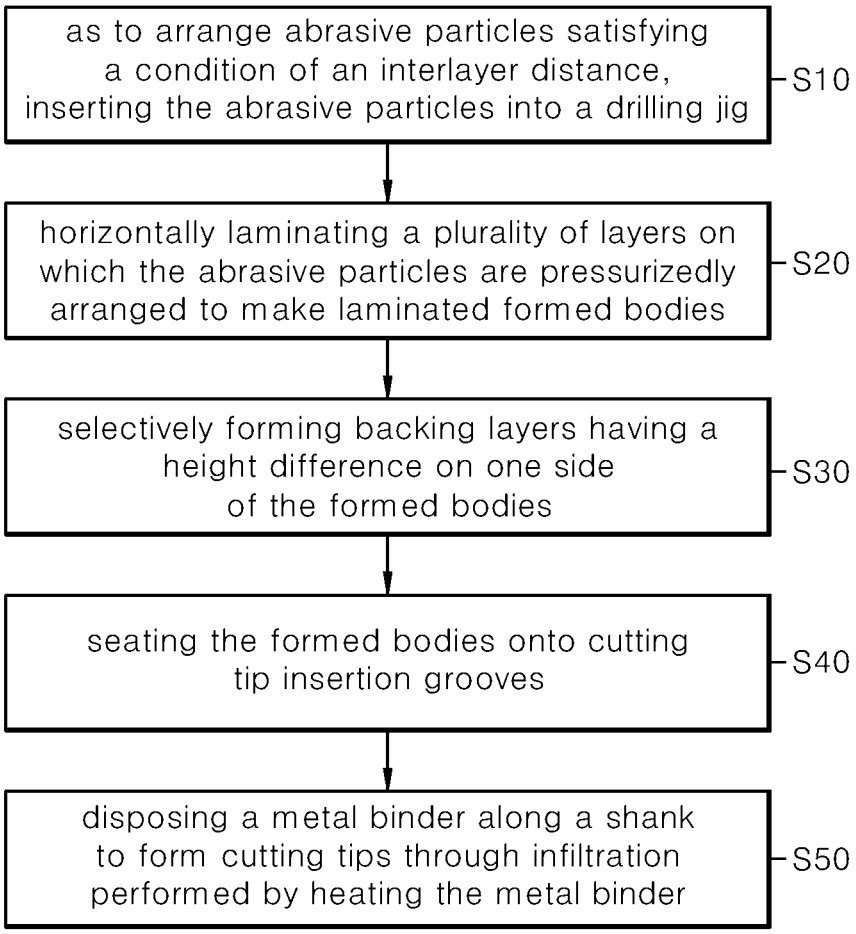
FIG. 9 is a flowchart showing a method for manufacturing the mining bit according to the present invention.

FIG. 9 is a flowchart showing a method for manufacturing the mining bit 200 according to the present invention. At this time, the mining bit 200 is the same as mentioned above, and therefore, a detailed explanation on the same reference numerals will be avoided for the brevity of the description.

As shown in FIG. 9, so as to arrange the abrasive particles P satisfying the condition of the interlayer distance S, the abrasive particles P are inserted into the drilling jig having the through holes larger than the sizes F of the abrasive particles P after having a thin layer of metal powder applied thereto, taking a shape of an arch, and being flattened (at step S10). The condition of the interlayer distance S according to the present invention satisfies that the S/D1 is less than the radical root of ⅔ and greater than F/2. After the drilling jig is removed, next, the abrasive particles P are pressurized to form one layer. The formability is repeatedly performed to make preformed bodies, and then, the plurality of layers on which the abrasive particles are arranged are pressurizedly laminated onto each other in the horizontal direction h to make a plurality of laminated formed bodies (at step S20). As a result, the plurality of arch-shaped formed bodies are made, and each formed body has the same width w, the rounded inner and outer surfaces 21 and 22, and the outer surface 22 having a longer length than the inner surface 21.

In some cases, the respective formed bodies have the backing layers 23 and 24 having the height difference ΔH formed on one side thereof (at step S30). After that, the formed bodies are inserted into the cutting tip insertion grooves 11 (at step S40). After the metal binder is disposed along the shank 10, the cutting tips 20 are made through the infiltration performed by heating the metal binder (at step S50). The infiltration is carried out by heating the metal binder in a state of a single metal or alloy over a melting point and by then filling the metal binder into the spaces between the abrasive particles through the capillary forces. The cutting tips 20 and the shank 10 are infiltrated unitarily with each other, thereby finishing manufacturing the mining bit 200. If the cutting tips 20 and the shank 10 are infiltrated unitarily with each other, the metal binder on the cutting tips 20 is coupled to the shank 10.

As described above, the mining bit according to the present invention has the plurality of cutting tips made, through the infiltration, by laminating the plurality of layers arranged horizontally with respect to the cut surface thereof under the condition where the distance between the adjacent layers is equal to or less than the sizes of the abrasive particles, so that each cutting tip is easily made, has a maximum concentration of abrasive particles, allows the cut surface to be rounded to induce optimal abrasion, and has a shape of the arch having the same width and rounded on the inner and outer surfaces thereof.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A mining bit comprising:

a cylindrical shank capable of being rotatingly connected to a driving device; and a cutting tip attached to the cylindrical shank, the cutting tip being attached at regular intervals along a circular path of an end portion of the cylindrical shank, the cutting tip having a cutting direction corresponding to a longitudinal direction of the cylindrical shank and a horizontal cutting surface perpendicular to the cutting direction, wherein the cutting tip has a shape of an arch having a curvature corresponding to that of the cylindrical shank, wherein the cutting tip is formed of two or more layers laminated along the cutting direction of the cutting tip, each of the two or more layers is a flat layer having abrasive particles arranged therein, the abrasive particles have a particle size (F), and neighboring two layers have a normal interlayer distance (S), wherein a distance (D1) between the abrasive particles on each layer of the two or more layers is larger than a distance (D2) between the abrasive particles and abrasive particles on a neighboring layer to the each layer, wherein the normal interlayer distance (S) is equal to or less than the particle size (F) and larger than half (F/2) of the particle size (F), and is less than a radical root of ⅔ of the distance (D1), and wherein the cutting tip includes a backing layer in contact with the shank, the backing layer has a height, the height is a height difference from a height of a backing layer of a neighboring cutting tip, and the height difference is less than the normal interlayer distance (S).

2. The mining bit according to claim 1, wherein the horizontal cutting surface exposed to outside has a rounded edge.

3. The mining bit according to claim 1, wherein spaces among the abrasive particles are filled with a metal binder.

* * * * *